US008458941B2

(12) United States Patent
Pagones

(10) Patent No.: US 8,458,941 B2
(45) Date of Patent: Jun. 11, 2013

(54) SHIPMENT LABELS AND RELATED METHODS

(75) Inventor: James Harrison Pagones, Slidell, LA (US)

(73) Assignee: Moore Wallace North America, Inc., Stamford, CT (US)

( * ) Notice: Subject to any disclaimer, the term of this patent is extended or adjusted under 35 U.S.C. 154(b) by 314 days.

(21) Appl. No.: 12/763,908

(22) Filed: Apr. 20, 2010

(65) Prior Publication Data

US 2011/0253576 A1 Oct. 20, 2011

(51) Int. Cl.
*G09F 3/10* (2006.01)

(52) U.S. Cl.
USPC ..... 40/638; 428/42.3

(58) Field of Classification Search
USPC ..... 40/630, 638
See application file for complete search history.

(56) References Cited

U.S. PATENT DOCUMENTS

| | | | |
|---|---|---|---|
| 3,683,806 | A | 8/1972 | Rudolph |
| 3,711,353 | A | 1/1973 | Zimmer |
| 3,864,855 | A | 2/1975 | Pekko et al. |
| 4,060,168 | A | 11/1977 | Romagnoli |
| 4,281,762 | A | 8/1981 | Hattemer |
| 4,379,573 | A | 4/1983 | Lomeli et al. |
| 4,479,838 | A | 10/1984 | Dunsirn et al. |
| 4,544,590 | A | 10/1985 | Egan |
| 4,568,403 | A | 2/1986 | Egan |
| 4,767,654 | A | 8/1988 | Riggsbee |
| 4,810,121 | A | 3/1989 | Uneo et al. |
| 4,846,504 | A | 7/1989 | MacGregor et al. |
| 4,863,772 | A | 9/1989 | Cross |
| 4,864,504 | A | 9/1989 | Koshizawa et al. |
| 4,872,707 | A | 10/1989 | deBruin |
| 4,925,714 | A | 5/1990 | Freedman |
| 4,965,438 | A | 10/1990 | Murofushi |
| 4,982,894 | A | 1/1991 | Schmidt |
| 5,011,559 | A | 4/1991 | Felix |
| 5,019,436 | A | 5/1991 | Schramer et al. |
| 5,024,014 | A | 6/1991 | Swierczek |
| 5,106,124 | A | 4/1992 | Volkman et al. |
| 5,131,686 | A | 7/1992 | Carlson |
| 5,237,394 | A | 8/1993 | Eaton |
| 5,238,720 | A | 8/1993 | Volkman |
| 5,284,689 | A | 2/1994 | Laurash |
| 5,292,713 | A | 3/1994 | Stenzel et al. |
| 5,329,713 | A | 7/1994 | Lundell |
| 5,350,612 | A | 9/1994 | Stern et al. |
| 5,380,045 | A | 1/1995 | Comann |
| 5,403,236 | A | 4/1995 | Greig |
| 5,413,384 | A | 5/1995 | Principe et al. |
| 5,413,532 | A | 5/1995 | Raby |
| 5,417,790 | A | 5/1995 | Petrou |
| 5,535,536 | A | 7/1996 | Comann |
| 5,571,358 | A | 11/1996 | Napier et al. |

(Continued)

*Primary Examiner* — Joanne Silbermann
(74) *Attorney, Agent, or Firm* — Hanley, Flight and Zimmerman, LLC

(57) ABSTRACT

Shipment labels and related methods are described. An example method includes printing a return address on a first label layer of the label and printing a delivery address on a second label layer of the label adjacent the first label layer. The example method also includes coupling the first label layer and the second label layer on at least a portion of a container. The second label layer releasably covers at least a portion of the first label layer so that the return address is not fully visible when the second label layer is releasably coupled to the container.

17 Claims, 9 Drawing Sheets

U.S. PATENT DOCUMENTS 5,628,858 A 5/1997 Petrou
5,658,631 A 8/1997 Bernstein
5,661,099 A 8/1997 Mitchell
5,750,192 A 5/1998 Smith
5,824,380 A 10/1998 Hagen
5,855,434 A 1/1999 Hagen
5,915,733 A 6/1999 Schnitzer et al.
5,951,054 A 9/1999 Hagen et al.
5,958,536 A * 9/1999 Gelsinger et al. ..... 428/40.1
6,022,442 A 2/2000 Seidl
6,173,901 B1 1/2001 McCannel
6,352,287 B2 3/2002 Casagrande
6,403,191 B1 6/2002 Casagrande
6,471,815 B1 10/2002 Mace
6,594,927 B2 7/2003 Witkowski
6,688,649 B2 2/2004 Casagrande
6,709,726 B1 3/2004 Dronzek et al.
6,756,095 B2 6/2004 Sandt et al.
6,890,112 B2 * 5/2005 Kline ..... 400/615.2
6,988,665 B2 1/2006 Schofield
6,991,259 B2 1/2006 Schwarzbauer et al.
7,013,589 B2 3/2006 Dickinson et al.
7,106,202 B2 9/2006 Dickinson
7,155,854 B2 1/2007 Dickinson
7,182,259 B2 2/2007 Lubow et al.
7,475,912 B1 * 1/2009 Reffett ..... 283/81
2001/0035645 A1 11/2001 Carides et al.
2002/0185212 A1 12/2002 Schaupp et al.
2003/0020274 A1 1/2003 Milliorn
2003/0217489 A1 11/2003 Witkowski
2004/0007557 A1 1/2004 Maliszewski et al.
2004/0018289 A1 1/2004 McQueeny et al.
2004/0091659 A1 * 5/2004 Banks et al. ..... 428/41.8
2004/0111934 A1 6/2004 O'Connell
2004/0155453 A1 8/2004 Ross
2004/0212190 A1 10/2004 Miller
2004/0237362 A1 12/2004 O'Connell
2005/0229450 A1 10/2005 Larsen et al.
2007/0145142 A1 6/2007 Lubow et al.
2007/0229236 A1 10/2007 Mercer et al.
2008/0115465 A1 5/2008 Dickinson

* cited by examiner

SHIPMENT LABELS AND RELATED METHODS

FIELD OF THE DISCLOSURE

The present disclosure relates generally to forms and, more particularly, to shipment labels and related methods.

BACKGROUND

In the manufacture of shipment labels, outgoing address labels and return address labels are typically made separately. In certain instances, a vendor or retailer may desire to return a package. Typically, where such a return is desired, the vendor or retailer places a preprinted return label inside a delivered package. This requires opening the package to insert the return label. Once received, the consumer must also open the package, find the return label placed inside and properly place the label on the outside of the package for return. This method can lead to numerous errors.

One known example shipment label that includes an outgoing label and a return label includes two separate removable labels that are disposed within a transparent sleeve that overlays an exterior portion of a package. However, this construction requires additional plastic sleeve material and, therefore, is more complex and costly to produce. In addition, the separate removable labels could be displaced from the interior of the sleeve and lost.

Other known example shipment labels include a label panel on an exterior surface of a package. The label panel contains instructions for the placement of removable labels thereon. However, a second label (e.g., a return label) would have to be placed inside the package or otherwise obtained from the consumer. This arrangement has the same propensity for errors as identified above.

DETAILED DESCRIPTION

Figure 1:
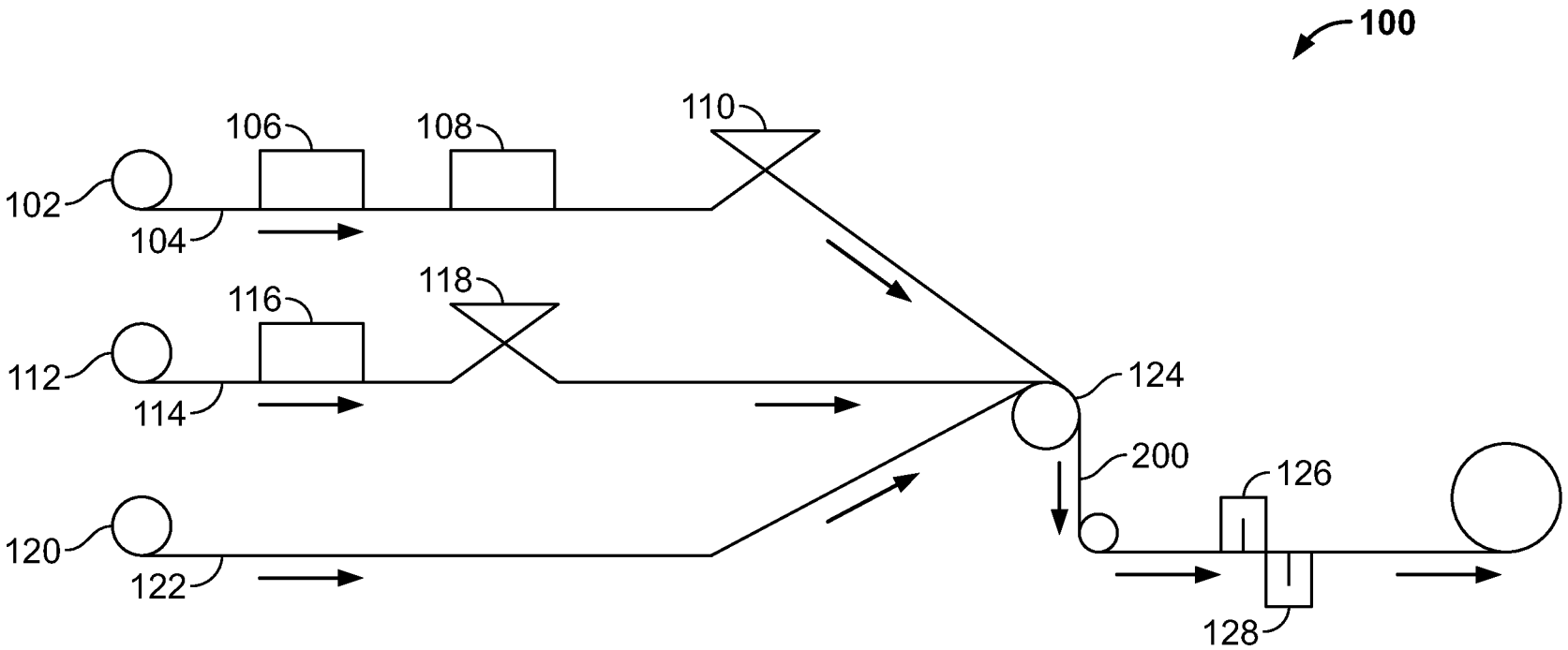
FIG. 1 is a schematic view of an example apparatus for practicing an example method described herein for producing an example shipment label.

Certain examples are shown in the above-identified figures and described in detail below. In describing these examples, like or identical reference numbers may be used to identify common or similar elements. The figures are not necessarily to scale and certain features and certain views of the figures may be shown exaggerated in scale or in schematic for clarity and/or conciseness.

Dual or multi-layer shipment labels are important for a variety of reasons. For example, dual layer shipment labels enable a vendor or retailer to send a package or container to a consumer using an outgoing or delivery address printed on a top, upper, outgoing or delivery address label that includes, for example, address information for a business consumer, an individual consumer, or any other end user. If the consumer has to resend the package to another location such as, for example, a returns processing center, a service technician, a recycler or any other address because, for example, the items contained in the package are not the items ordered, are damaged, need to be disposed of, or otherwise need to be processed or serviced at another location, the consumer can remove the delivery address label containing the consumer's information, as instructed, for example, by the manufacturer, vendor or retailer, to reveal or expose a bottom, lower, secondary or return address label that includes, for example, address information for a business entity, nonprofit organization or any other organization or association.

In general, the example apparatus, methods and articles of manufacture described herein provide for an example dual layer shipment label that enables a manufacturer, vendor or retailer to print and provide a return address label on the surface of a container hidden beneath a delivery address label so as to not interfere with the initial delivery of the container. The manufacturer, vendor or retailer can provide the return address label in a properly placed position to ensure the label is not lost, damaged or improperly affixed or coupled to the container prior to return by the consumer. This arrangement decreases the costs associated with printed and sending additional return labels to the consumer. In addition, this ensures that the containers will be properly addressed for the return shipment, which decreases the quantity of lost, misaddressed or misdelivered containers.

More specifically, one of the example methods described herein is a method of forming a double layered shipment label that includes printing a return address on a first label layer formed in, on or from a first substrate and printing a delivery address on a second label layer formed in, on or from the first substrate adjacent the first label layer. The example method also includes coupling the first label layer and the second label layer on at least a portion of a container. The second label layer releasably covers at least a portion of the first label layer so that the return address is not fully visible when the second label layer is releasably coupled to the container.

In addition, the first label layer may be permanently coupled to the container. The second label layer may substantially cover the first label layer on the container. In this example, the first label layer may be smaller in area than the second label layer.

In at least some of the example methods described herein, each of the first label layer and the second label layer may be formed via an example process that includes lining a first side of the first substrate layer with a first adhesive layer and coating at least a portion of the first adhesive layer with a varnish in a first area to deaden the first adhesive layer in the first area. In addition, the example process includes lining a first side of a second substrate layer with a second adhesive layer and coupling or marrying the first substrate and the second substrate layer so that the first side of the first substrate layer is adjacent a second side of the second substrate layer via the first adhesive layer. In addition, the example process includes coupling or marrying the second substrate layer to a third substrate layer so that the first side of the second substrate layer is adjacent the third substrate layer via the second adhesive layer to form an intermediate construction having a bottom side at the third substrate layer and a top side at the first substrate layer. The example process may also include cutting or otherwise forming lines of weakness in the intermediate construction from the bottom side through the second and third substrate layers to later facilitate the removal of the first and second label layers. Furthermore, the examples described herein include cutting or otherwise forming lines of weakness in the intermediate construction from the top side through the first and second substrate layers to form the first label layer and the second label layer adjacent to each other along a longitudinal axis of the intermediate construction and to form a waste matrix.

Also described herein are example webs of shipment label intermediates. An example web includes a first substrate layer having a first side lined with a first adhesive layer and a varnish portion coating at least a portion of the first adhesive layer to deaden the portion of the first adhesive layer. The example web also includes a second substrate layer having a first side lined with a second adhesive layer, and the first substrate and the second substrate layer are coupled so that the first side of the first substrate layer is adjacent a second side of the second substrate layer via the first adhesive layer. There may also be a third substrate layer to which the second substrate layer is coupled so that the first side of the second substrate layer is adjacent the third substrate layer via the second adhesive layer.

The example web may also include a first line of weakness through the first, second and third substrate layers to form a plurality of intermediate constructions having a bottom side at the third substrate layer and a top side at the first substrate layer, a second line of weakness formed from the bottom side through the second and third substrate layers, and a third line of weakness formed from the top side through the first and second substrate layers to form a the first label layer and the second label layer adjacent to each other along a longitudinal axis of the intermediate construction and to form a waste matrix.

Also described herein are example containers with example double layered shipment labels coupled thereto. The example containers and labels include a container surface and a lower return address label layer formed from a first substrate and coupled to at least a portion of the container surface. The lower return address layer may be releasably or permanently coupled to the container surface. A return address such as, for example, the address to return a package or container to a vendor, retailer or manufacturer or to the send the container to a service technician, recycler or other third party location is printed on the lower return address label layer.

The example container also includes a removable upper delivery address label layer formed from the first substrate, that is, the same substrate as the return address label layer. The delivery address label layer may be coupled to the lower label such that the delivery address label layer releasably covers at least a portion of the lower return address label layer so that the return address is not fully visible when the delivery address label layer is releasably coupled to the container surface. A delivery address such as, for example, the address of a consumer, including business consumers or other end users, is printed on the upper delivery address label layer.

Figure 2:
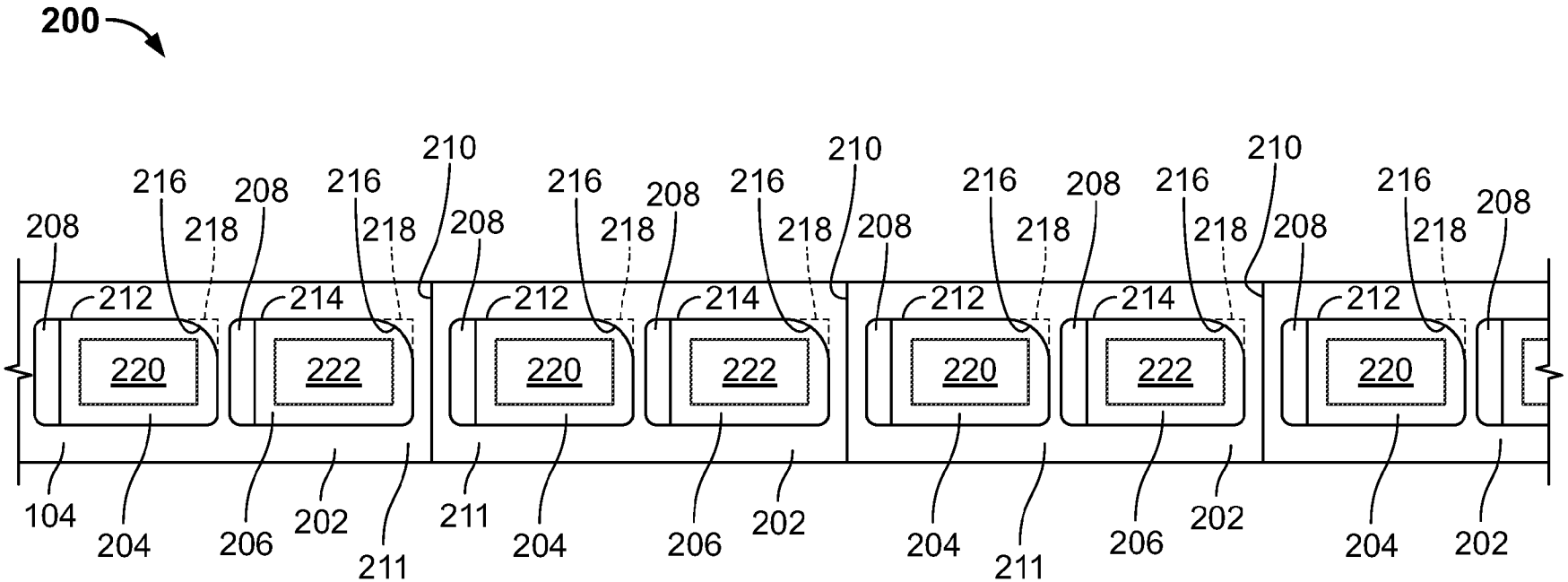
FIG. 2 is a schematic view of a portion of an example web of a plurality of example shipment label intermediates.
Figure 6:
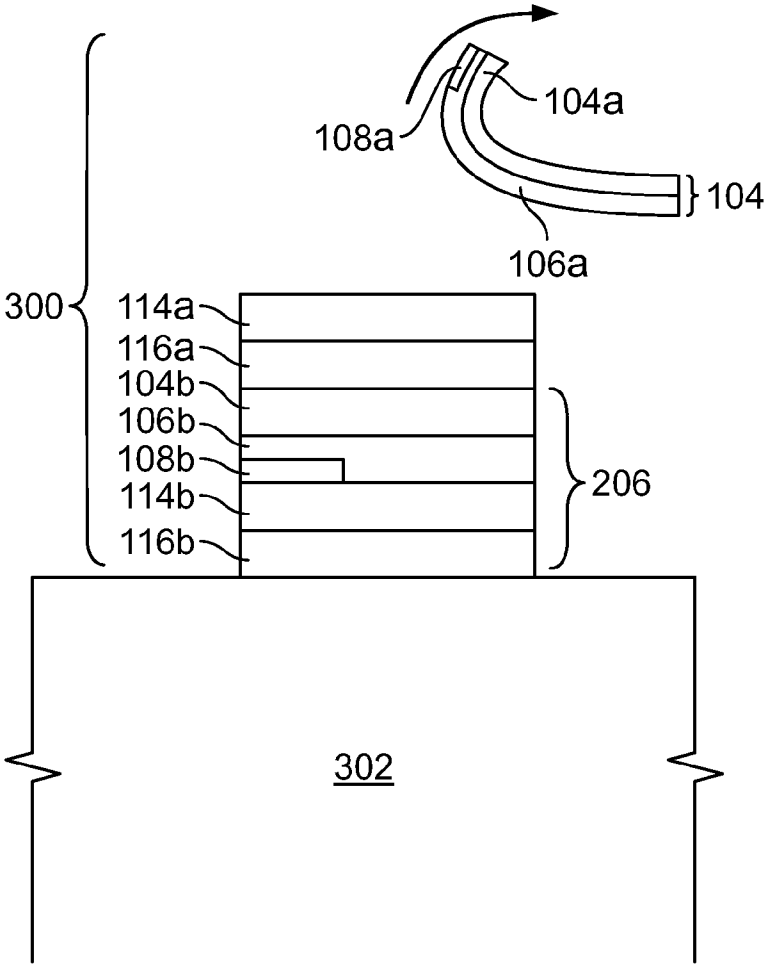
FIG. 6 is a cross-sectional view of the example shipment label of FIGS. 3 and 4 coupled to an example container with a portion of an example outgoing label removed.
Figure 7:
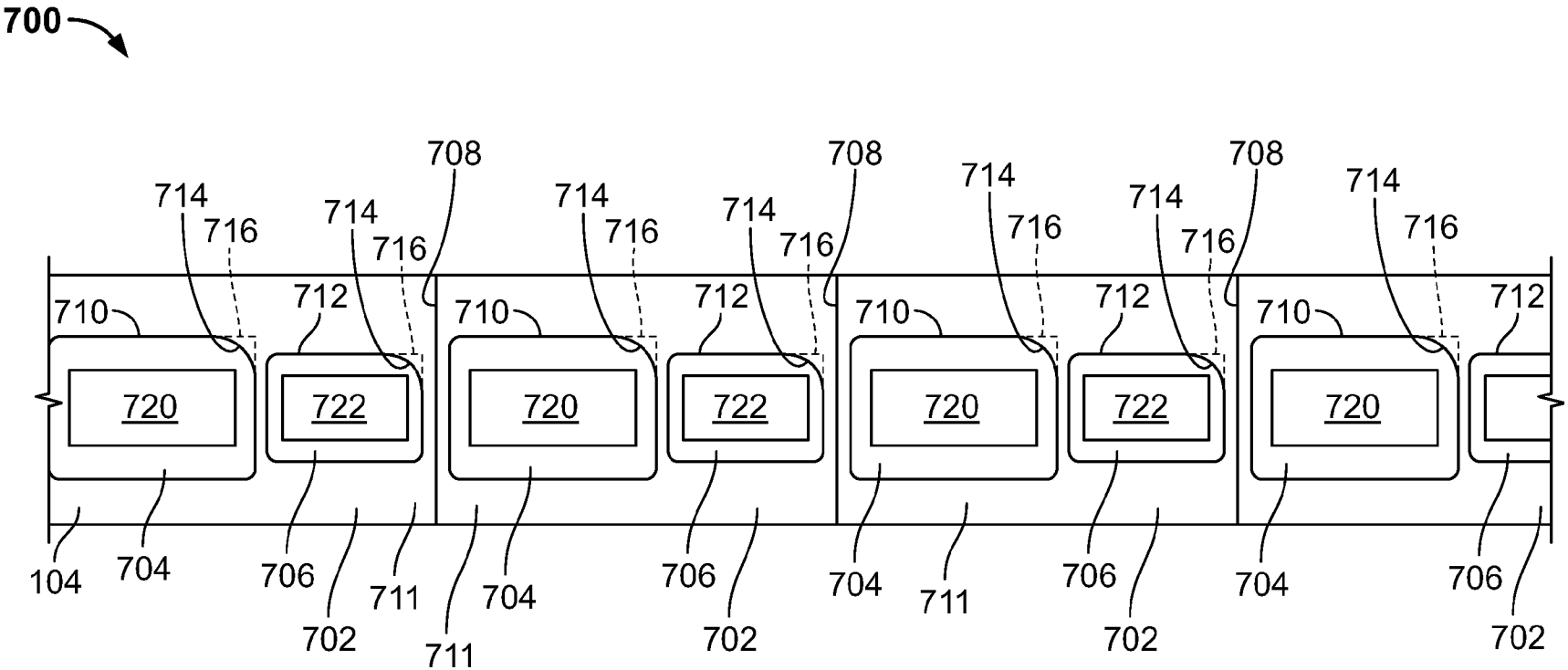
FIG. 7 is a schematic view of a portion of an alternative example web of a plurality of alternative example shipment label intermediates.

Now turning to the figures, FIG. 1 illustrates an example apparatus 100 for practicing one of the example methods described herein for producing an example web 200, 700 (FIGS. 1, 2 and 7) containing one or more example shipment label intermediates 202, 702 (FIGS. 2 and 7). The example shipment label intermediate 202, 702 is an intermediary form or construction that includes the layers used to form an example dual or multi-layer shipment label 300, 800 (FIGS. 3-6 and 8-11). In some examples, the example shipment label intermediate 202, 702 is the structure in which the dual layer shipment label 300, 800 is provided to a user prior to use of the example dual layer shipment label 300, 800.

The example apparatus 100 will be described for producing the example shipment label web 200 and shipment label 300 of FIGS. 2-6. However, the same apparatus 100 or a similar apparatus may be used to produce the example web 700 and shipment label 800 of FIGS. 7-10. As shown in FIG. 1, the example apparatus 100 includes a first unwinder 102 that unwinds a top ply 104. In this example the top ply 104 is a roll of paper (e.g., FX-4 Code 1257), a plastic material (e.g., polypropylene), other synthetic substrates or any other suitable substrate, including a combination of materials. At a first adhesive station 106, the top ply 104 receives a layer of adhesive which may be, for example, a continuous layer or a pattern of adhesive. In addition, the adhesive layer may be a removable or repositionable adhesive, pressure sensitive adhesive and/or any other suitable adhesive. As described below, portions of the adhesive layer may also be a permanent adhesive. After the adhesive layer is applied to the top ply 104, the top ply enters a varnishing station 108. The varnishing station 108 may be one and the same as the first adhesive station 106. At the varnishing station a varnish or other deadening material is applied to a portion of the adhesive layer on the first ply 104 to deactivate or deaden the portion of the adhesive layer. The portion may be, for example, one of the corners of the layers of the shipment label, as described in greater detail below. Furthermore, the varnish, in some examples, is a silicone layer or any other suitable material for deadening the portion of the adhesive layer. After the varnish is applied, the top ply 104 is optionally inverted at turn bar 110. If the adhesive and varnish were applied at the top of the top ply 104, then the turn bar 110 may be needed to reorient the top ply 104 depending on the orientation of other plies to which the top ply 104 is later married as described below.

The example apparatus 100 also includes a second unwinder 112 that unwinds a second ply 114. In this example the second ply 114 is a clear silicone substrate though, in other examples, any other suitable substrate, including a combination of materials may be used. At a second adhesive station 116, the second ply 114 receives a second layer of adhesive which may be, for example, a continuous layer or a pattern of adhesive. In addition, the second adhesive layer may be a removable or repositionable adhesive, pressure sensitive adhesive and/or any other suitable adhesive including, for example, permanent adhesives (at least for portions of the second adhesive layer). The second adhesive station 116 may be one and the same as the first adhesive station 106. After the second adhesive layer is applied, the second ply 114 is optionally inverted at a second turn bar 118. If the second adhesive layer was applied at the top of the second ply 114, then the second turn bar 118 may be needed to reorient the second ply 114 depending on the orientation of other plies to which the second ply 114 is later married as described below. Also, in some example, the second ply 114 is omitted.

The example apparatus 100 also includes a third unwinder 120 that unwinds a third or bottom ply 122. In this example, the bottom ply 122 is a release liner or base ply comprising a clear 1.5 mil (PET At333 with 50# SCK liner). However, the bottom ply 122 can be any suitable olefin, PET, or other substrate material or combination thereof.

One or more of the sides of the top ply 104, the second ply 114 and the bottom ply 122 can be treated with a silicone coating release layer. In addition, the top ply 104 may optionally be printed by printers (not shown) in the apparatus 100.

After the top ply 104, the second ply 114 and the bottom ply 122 are treated (e.g., given a layer of adhesive, varnish, release coating and/or printing) and properly oriented, the top ply 104, the second ply 114 and the bottom ply 122 are fed into a press 124 and married or otherwise coupled to form the example web 200. The web 200 is die cut via a first cutter 126 and a second cutter 128, which may be implemented as one device. The first cutter 126 cuts through the top ply 104 and the second ply 114 from the top or exposed face of the top ply 104, and the second cutter 128 cuts through the bottom ply 122 and the second ply 114 from the exposed face of the bottom ply 122. In addition, one or more of the first cutter 126, the second cutter 128 or a third cutter (not shown), cuts through the entire web 200 to form the plurality of shipment label intermediates. The types, position and other characteristics of the cuts made by the first cutter 126 and the second cutter 128 are described in greater detail below. After the cuts are made, the web 200 is wound or folded for transportation, storage, etc.

FIG. 2 shows the example web 200 as including a plurality of example shipment label intermediates 202. Each shipment label intermediate 202 includes a first label 204 and a second label 206. The first labels 204 may also be referred to as top labels, upper labels, delivery address labels, outgoing labels and the like. The second labels 206 may also be referred to as bottom labels, lower labels, return address labels, return labels and the like. The terms "first" and "second" are not limiting and may be used interchangeably in some examples described and claimed herein. Likewise "top" and "bottom" are not limiting and may be used interchangeably depending upon how the labels are oriented or placed as described and claimed herein. Each of the first label 204 and the second label 206 includes a supplementary label 208. The supplementary labels 208 may be used for bookkeeping and auditing purposes. In some examples (e.g., FIG. 7), the supplementary labels 208 are omitted.

The shipment label intermediates 202 also have several die cuts created by one or more of the first cutter 126 and/or the second cutter 128. A first die cut 210 in the web 200 cuts entirely through the web 200 and separates the plurality of shipment label intermediates. A second die cut 212 outlines the top labels 204, and a third die cut 214 outlines the bottom labels 206. The second die cut 212 and the third die cut 214 extend through the top ply 104 and the second ply 114 and form a waste matrix 211. The bottom ply 122 forms the release liner and backing and does not include (i.e., is not penetrated or otherwise weakened by) the second die cut 212 and the third die cut 214. In the example of FIG. 2, the second die cut 212 and the third die cut 214 are substantially similar and create the top labels 204 and the bottom labels 206 to have substantially the same dimensions.

The corners of the second die cut 212 and the third die cut 214 may be rounded or radiused. In addition, one corner 216 may have a relatively larger radius than other corners defined by the die cuts 212, 214. Thus, one or more of the corners of at least one of the first label layer 204 or the second label layer 206 are rounded to have a first radius and one or more of the other corners of at least one of the first label layer 204 or the second label layer 206 are rounded to have a second radius so that the second radius is larger than the first radius. The rounded profile of the corners facilitates the addition of a fourth die cut 218, which facilitates removal of the labels 204, 206 from the web 200. The fourth die cut 218 extends through the bottom ply 122 and the second ply 114. The fourth die cut 218 may be created on the web 200 from above or below the web 200. In this example, the die cuts may be any type of cut, perforation, fold or other line of weakness One or more of the top ply 104, the second ply 114 and/or the bottom ply 122 may be printed with a delivery address 220 or a return address 222 prior to the marriage of the plies 104, 114 and 122 via the press 124. Further, the top ply 104 and/or the bottom ply 122 may be printed after marriage of the plies 104, 114 and 122 in the press 124. In other examples, none of the plies 104, 114 and 122 may be printed by the manufacturer. Instead a vendor or retailer who purchases the web 200, a portion of the web 200 and/or one or more shipment label intermediates 202 may add printing to the shipment label intermediate 202. For example, the top ply 104, which includes the top labels 204 and the bottom labels 206 may be printed with address information. For example, the top label 204 may be printed with outgoing or delivery address information and the bottom label 206 may be printed with return or service address information. The top label 204 and the bottom label 206 are adjacent each other on the web 200 or in the intermediate 202. Thus, the delivery address on the top label and the return address on the bottom label are formed and printed adjacent each other.

When the web 200, a portion of the web 200 and/or a plurality of shipment label intermediates 202 are provided from a manufacturer to a vendor/retailer, the manufacturer may provide instructions for assembling a dual shipment label from the shipment label intermediates 202. The instructions may be included on the back of the bottom ply 122, in the waste matrix 211 or separately included. With the instructions, the manufacturer could direct the vendor/retailer to remove the bottom label 206 from the release backing bottom ply 122 and place the bottom label 206 on the exterior or a container or package to be shipped. Then, the vendor/retailer would be instructed to remove the top label 204 from the release backing bottom ply 122 and place the top label 204 over the bottom label 206. The top label 204 could be placed directly over the bottom label 206 to substantially cover the bottom label 206. Alternatively, the top label 204 could be placed over, but offset from the bottom label 206 with any return address indicia on the bottom label 206 covered or otherwise obscured by the top label 204.

Figure 4:
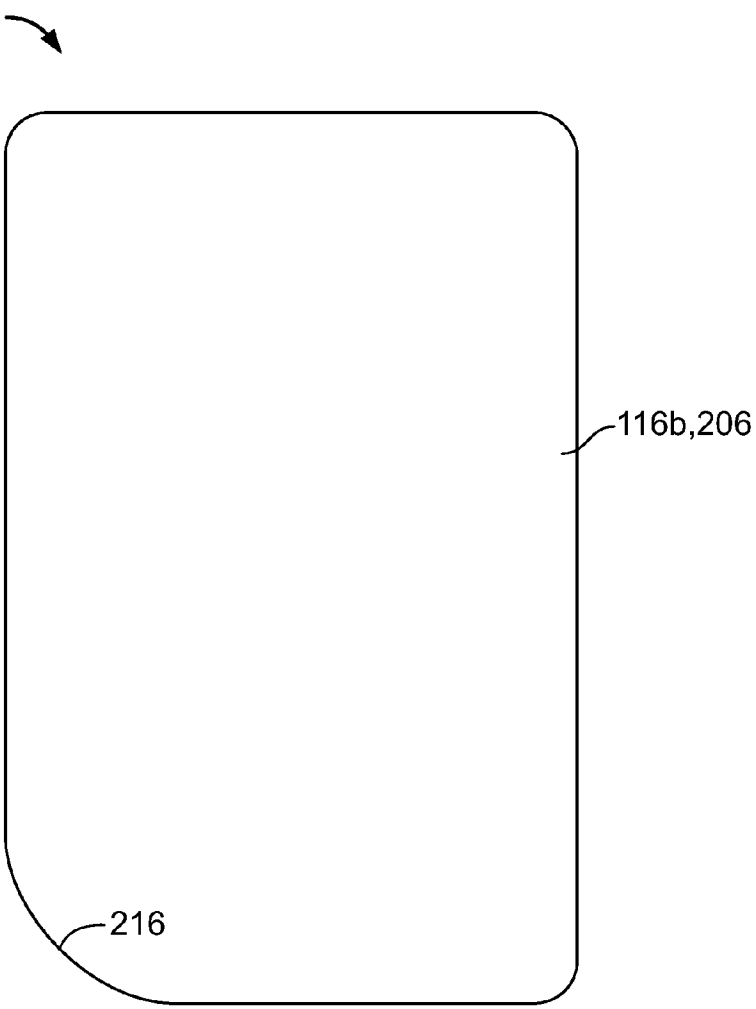
FIG. 4 is a back view of the example shipment label of FIG. 3.
Figure 3:
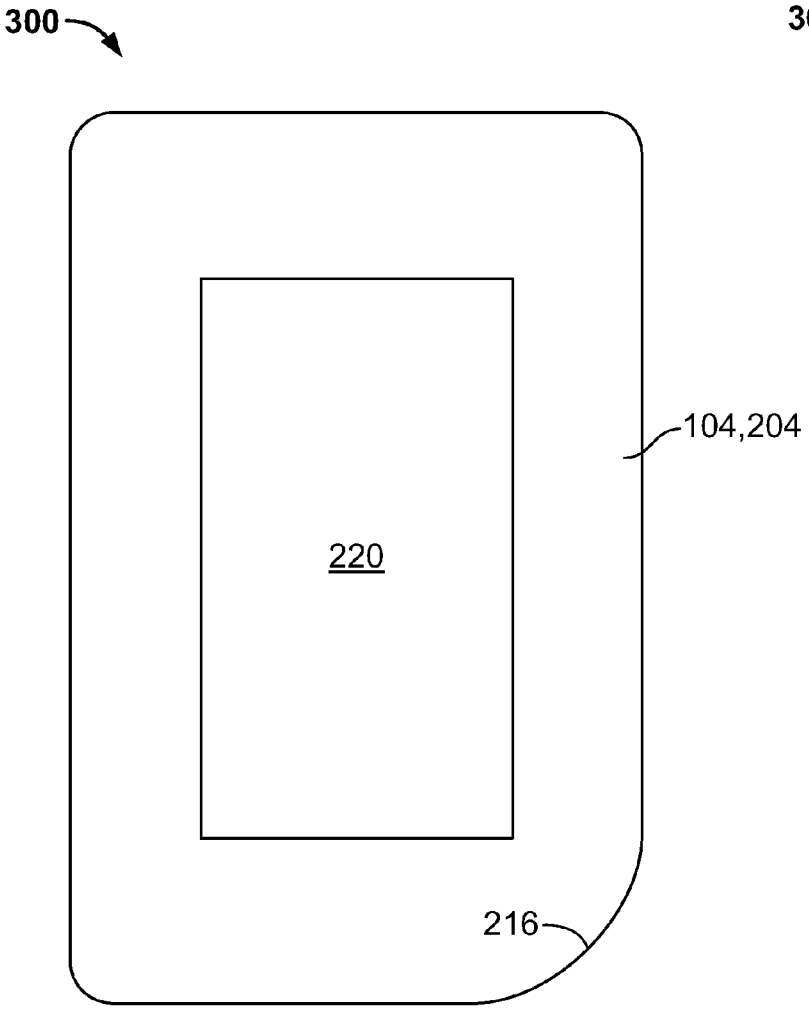
FIG. 3 is a front view of an example shipment label made from the example intermediates of FIG. 2.

FIGS. 3 and 4 show a dual layer shipment label 300 formed from the top label 204 and the bottom 206 when coupled together. FIG. 3 shows a top view, and FIG. 4 shows a bottom view. In the example shown in FIGS. 3 and 4, the top label 204 and the bottom label 206 are substantially the same size and dimensions and are substantially aligned. In this example two label layers are shown. However, in other examples there may be other numbers of label layers such as, for example, one, three, four, five, etc.

Figure 5:
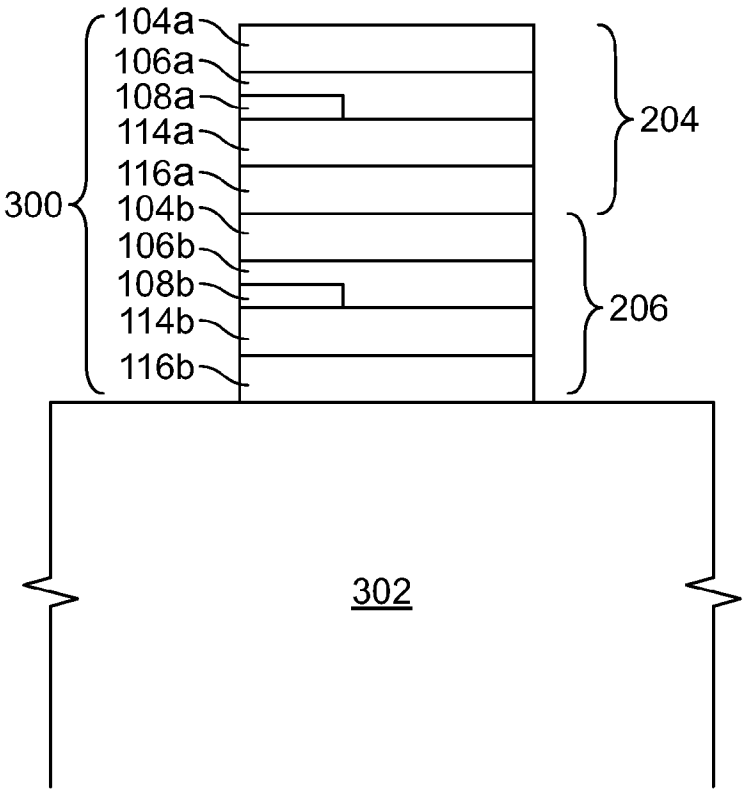
FIG. 5 is a cross-sectional view of the example shipment label of FIGS. 3 and 4 coupled to an example container.

FIG. 5 shows the dual layer shipment label 300 of FIGS. 3 and 4 coupled to a container or package 302. Only a portion of the container 302 is illustrated. As noted above, the dual layer shipment label 300 includes the top label 204 and the bottom label 206. The top label 204 includes a first portion **104*a* of the top ply 104, a first adhesive layer 106*a*, which may be produced by the first adhesive station 106** described above.

The top label 204 also includes a first varnish portion 108*a*, which may be produced by the first varnish station 108, as detailed above. The first varnish portion 108*a* deadens a portion of the first adhesive layer 106*a* to facilitate removal of the first portion 104*a* of the top ply 104 from the dual layer shipment label 300 as described below. The top label 204 also include a first portion 114*a* of the second ply 114 and a second layer of adhesive 116*a*, which may be produced by the second adhesive station 116 as described above. The top label 204 is coupled directly over the bottom label 206 in this example. The bottom label 206 has structure similar to the top label 204. Though, in other examples, as described herein, the structure of the bottom label 206 may differ from that of the top label 204.

As shown in FIG. 5, the bottom label 206 includes a second portion 104*b* of the top ply 104 with a third adhesive layer 106*b*, which may be produced by the first adhesive station 106. A second varnish portion 108*b* is provided on the bottom label 206 to deaden an area of the third adhesive layer 106*b*. However, this second varnish portion 108*b* may be included to facilitate application of the varnish to the top ply 104 and adhesive during manufacture, where it would be too difficult or lead to too many inaccuracies to have the varnish only applied to the first portion 104*a* of the top ply 104 and related adhesive (i.e., apply the varnish to every other label as it proceeds on the web 200). In other examples, the second varnish portion 108*b* may be omitted and thus, only the first varnish portion 108*a* is applied to the first portion 104*a* of the top ply 104 and first adhesive layer 106*a*. The bottom label 206 also includes a second portion 114*b* of the second ply 114 with a fourth adhesive layer 116*b*, which may be produced by the second adhesive station 116.

FIG. 6 shows the dual layer shipment label 300 with a portion of the top label 204 removed. When a recipient of the container 302 (i.e., the person or business to whom the delivery address was addressed) receives the container 302 and needs to send the container 302 back to the sender (i.e., a return addressee) or to a third party (e.g., a service addressee), the recipient will be instructed to peel the first portion 104*a* off the top ply 104 from the dual layer shipment label 300. The first varnish portion 108*a* enables the recipient to grasp the removable portion of the top label 204, and the first releasable adhesive layer 106*a* facilitates separation of the first portion 104*a* of the top ply 104 from the dual layer shipment label 300 as the recipient applies a separation force to the shipment label 300. The first portion 114*a* of the second ply 114 comprises a transparent or translucent material and, thus, forms a clear layer through which the return or service address that is printed on the top of the second portion 104*b* of the top ply 104 of the bottom label 206 is viewable. Thus, the first portion 114*a* of the second ply 114 forms a protective layer. In other examples, the entire top label 204 may be removed, which would include the removal of the first portion 114*a* of the second ply 114 and would expose the top surface of the bottom label 206. With at least the first portion 104*a* of the top ply 104 removed, the container 300 is ready for shipment to the return/service address printed on the bottom label 206.

FIGS. 7-11 illustrate another example dual shipment label 800 and web 700 of intermediates 702. As shown in FIG. 7, each shipment label intermediate 702 includes a first label 704 and a second label 706. The first labels 704 may also be referred to as top labels, upper labels, delivery address labels, outgoing labels and the like. The second labels 706 may also be referred to as bottom labels, lower labels, return address labels, return labels and the like. In this example, supplementary labels (e.g., supplementary labels 208 of the example of FIG. 2 are omitted).

The shipment label intermediates 702 also have several die cuts created by one or more of the first cutter 126 and/or the second cutter 128. A first die cut 708 in the web 700 cuts entirely through the web 700 and separates the plurality of shipment label intermediates 702. A second die cut 710 outlines the top labels 704, and a third die cut 712 outlines the bottom labels 706. The second die cut 710 and the third die cut 712 extend through the top ply 104 and the second ply 114 and form a waste matrix 711. The bottom ply 122 forms the release liner and backing and is not perforated or otherwise weakened by the second die cut 710 and the third die cut 712. In the example of FIG. 7, the second die cut 710 and the third die cut 712 are not substantially similar so that the top labels 704 and the bottom labels 706 that are not substantially the same dimensions. In this example, the bottom labels 706 are smaller than the top labels 704, which facilitates the covering or obscuring of the bottom labels 706 by the top labels 704 when the example dual layer shipment label 800 is assembled, as detailed below. Also, though the top labels 704 and the bottom labels 706 are shown as having similar shapes (e.g., similar profiles, shapes or outlines, though the relative sizes are different), in other examples, the top labels 704 and the bottom labels 706 could have different profiles, shapes or outlines.

The corners of the second die cut 710 and the third die cut 712 are shown as rounded or radiused. In other examples, the corners can be straight edges or any other shape. In addition, one corner 714 may have a relatively larger radius. Thus, one or more of the corners of at least one of the first label layer 704 or the second label layer 706 are rounded at a first radius and one or more of the other corners of at least one of the first label layer 704 or the second label layer 706 are rounded at a second radius so that the second radius is larger than the first radius. The rounded profile of the corners facilitates the addition of a fourth die cut 716, which facilitates removal of the labels 704, 706 from the web 700. The fourth die cut 716 extends through the bottom ply 122 and the second ply 114. The fourth die cut may be created on the web 700 from above or below the web 700.

The top label 704 and bottom label 706 may be printed and assembled in manners similar to that of the example described in FIGS. 2-6 with delivery address(es) 720 and/or return address(es) 722. For example, the labels 704, 706 may be printed at any time during the manufacturing process or afterwards, by a vendor or retailer. Further, when the web 700, a portion of the web 700 and/or a plurality of shipment label intermediates 702 are provided from a manufacturer to a vendor/retailer, the manufacturer may provide instructions for assembling a dual shipment label 800 (FIGS. 8-11) from the shipment label intermediates 702. For example, the manufacturer could instruct the vendor/retailer to remove the bottom label 706 from the release backing bottom ply 122 and place the bottom label 706 on the exterior or a container or package to be shipped. Then, the vendor/retailer would be instructed to remove the top label 704 from the release backing bottom ply 122 and place the top label 704 over the bottom label 706. The top label 704 could be placed over the bottom label 706 to substantially cover the bottom label 706. Because of the relative size difference between the top label 704 and the bottom label 706, exact alignment of the two labels 704, 706 is not necessary for the top label 704 to entirely cover the bottom label 706. Alternatively, the top label 704 could be placed over, but offset from the bottom label 706 with any return address indicia on the bottom label 706 covered or otherwise obscured by the top label 704.

Figure 9:
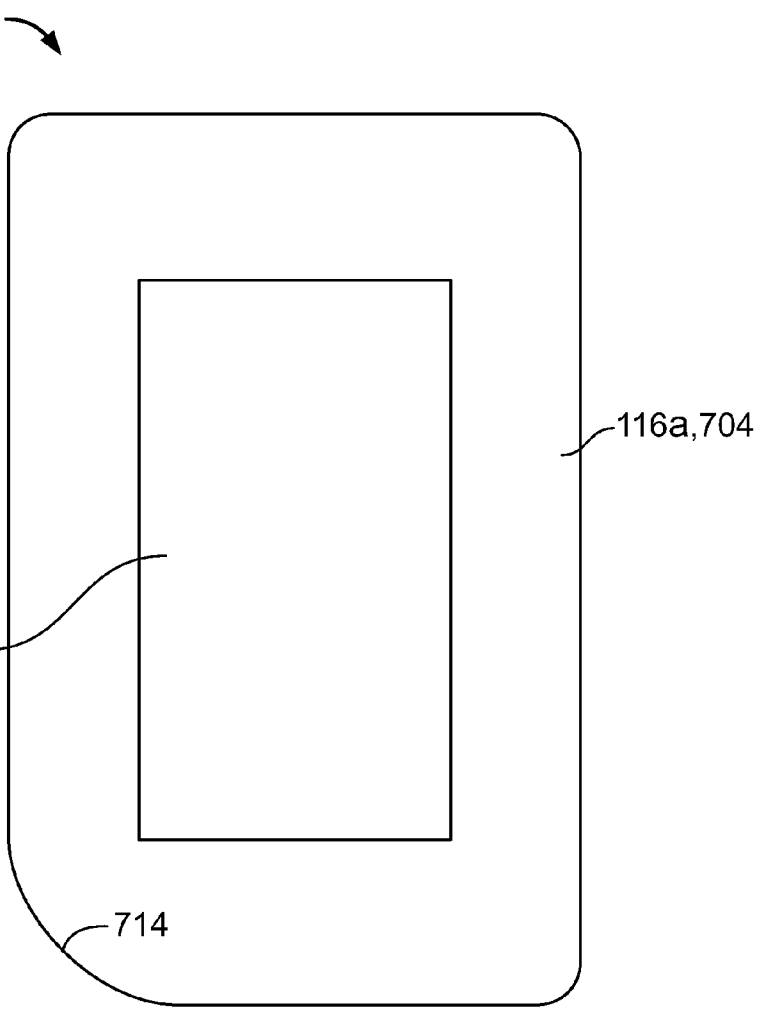
FIG. 9 is a back view of the example shipment label of FIG. 8.
Figure 8:
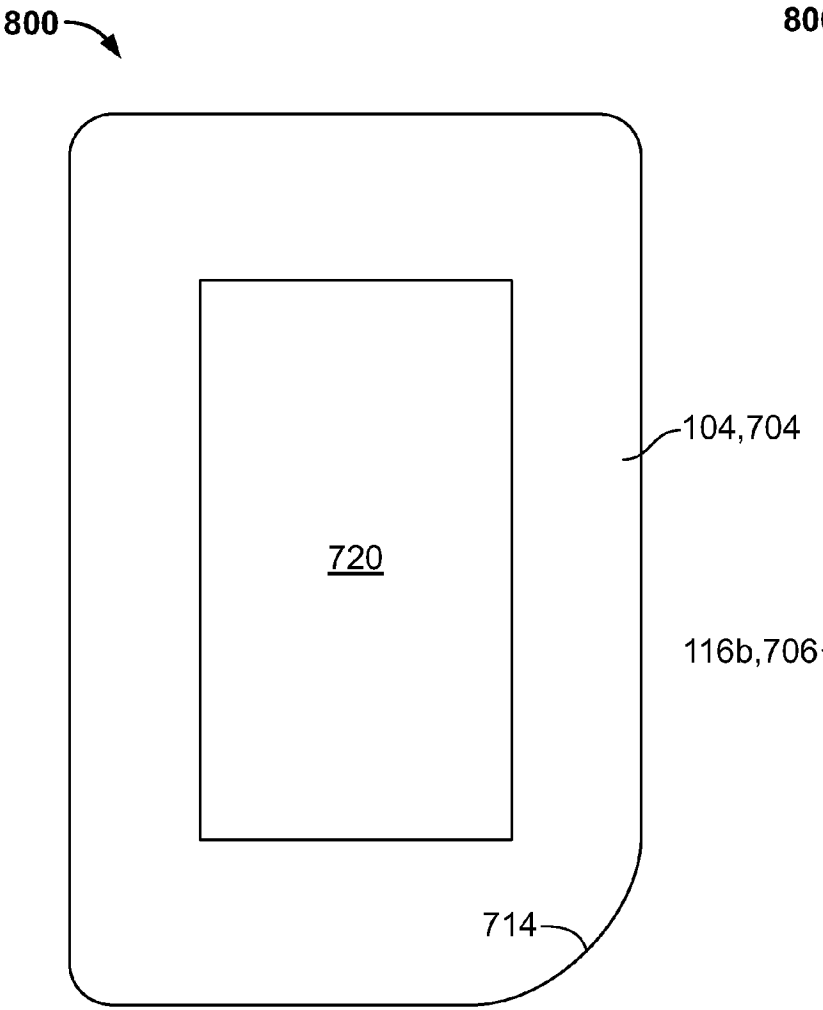
FIG. 8. is a front view of an alternative example shipment label made from the example intermediates of FIG. 7.

FIGS. 8 and 9 show a dual layer shipment label 800 formed from the top label 704 and the bottom 706 when coupled together. FIG. 8 shows a top view, and FIG. 9 shows a bottom view. FIGS. 8 and 9 illustrate how the different sizes of the labels 704, 706 facilitates how the top label 704 covers the bottom label 706.

Figure 10:
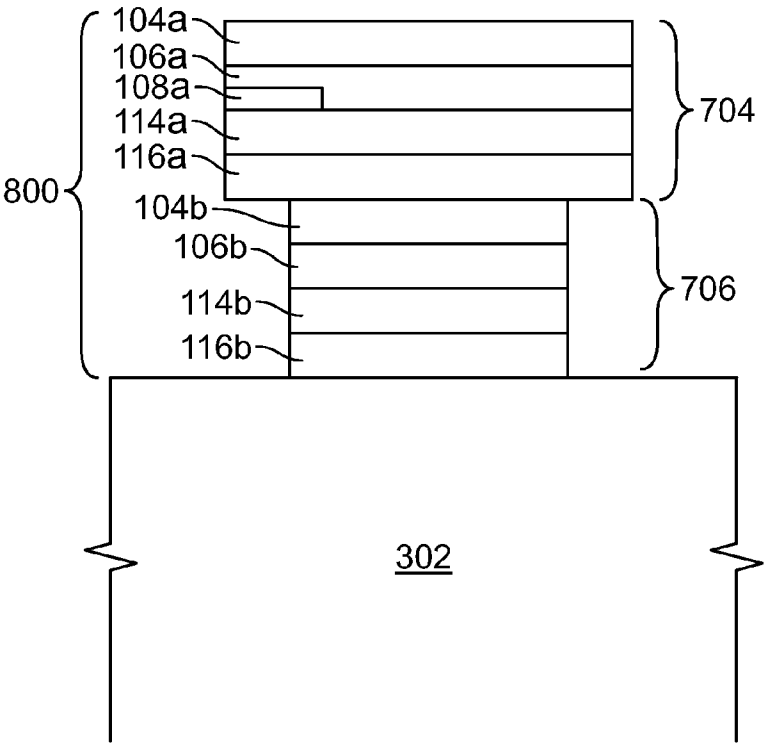
FIG. 10 is a cross-sectional view of the example shipment label of FIGS. 8 and 9.

FIG. 10 shows the dual layer shipment label 800 of FIGS. 8 and 9 coupled to the container or package 302. As noted above, only a portion of the container 302 is illustrated. The top label 704 has the same structure as the top label 204, described above and, thus, the description will not be repeated here. In addition, the bottom label 706 has the same structure as the bottom label 206 except the dimensions of the bottom label 706 are smaller and the bottom label 706 of FIGS. 10 and 11 does not include the second varnish portion 108*b*.

Figure 11:
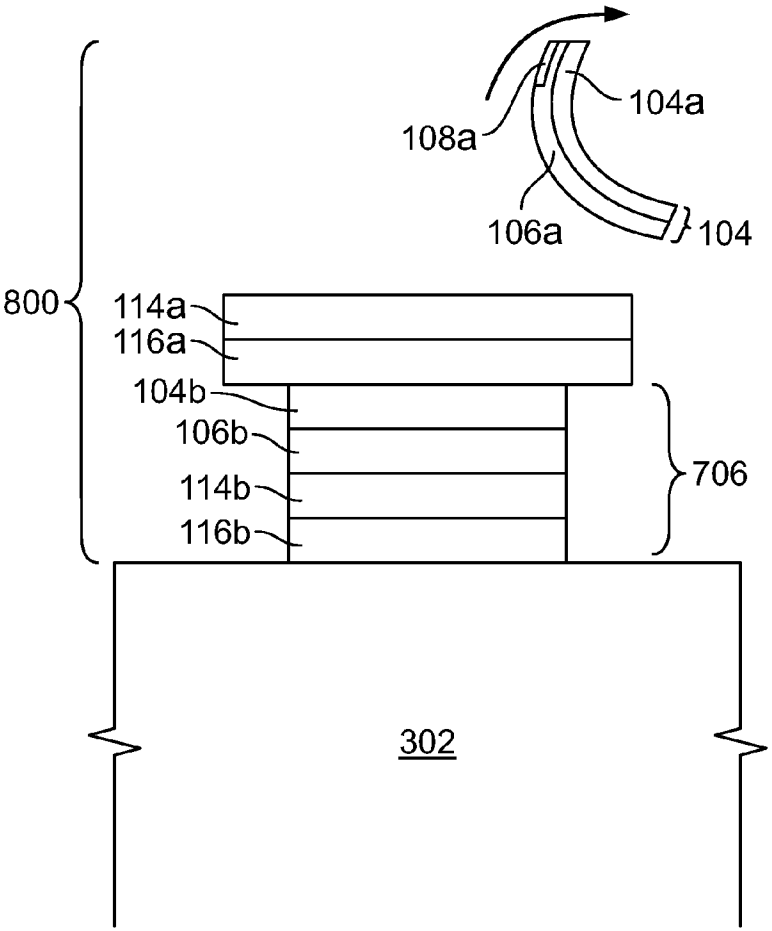
FIG. 11 is a cross-sectional view of the example shipment label of FIGS. 8 and 9 coupled to an example container with a portion of an example outgoing label removed.

FIG. 11 shows the dual layer shipment label 800 with a portion of the top label 704 removed. The example dual layer shipment label 800 of FIG. 11 works in the same manner as the dual layer shipment label 300 described above and, thus, details of the relevant description will not be repeated here.

Figure 12:
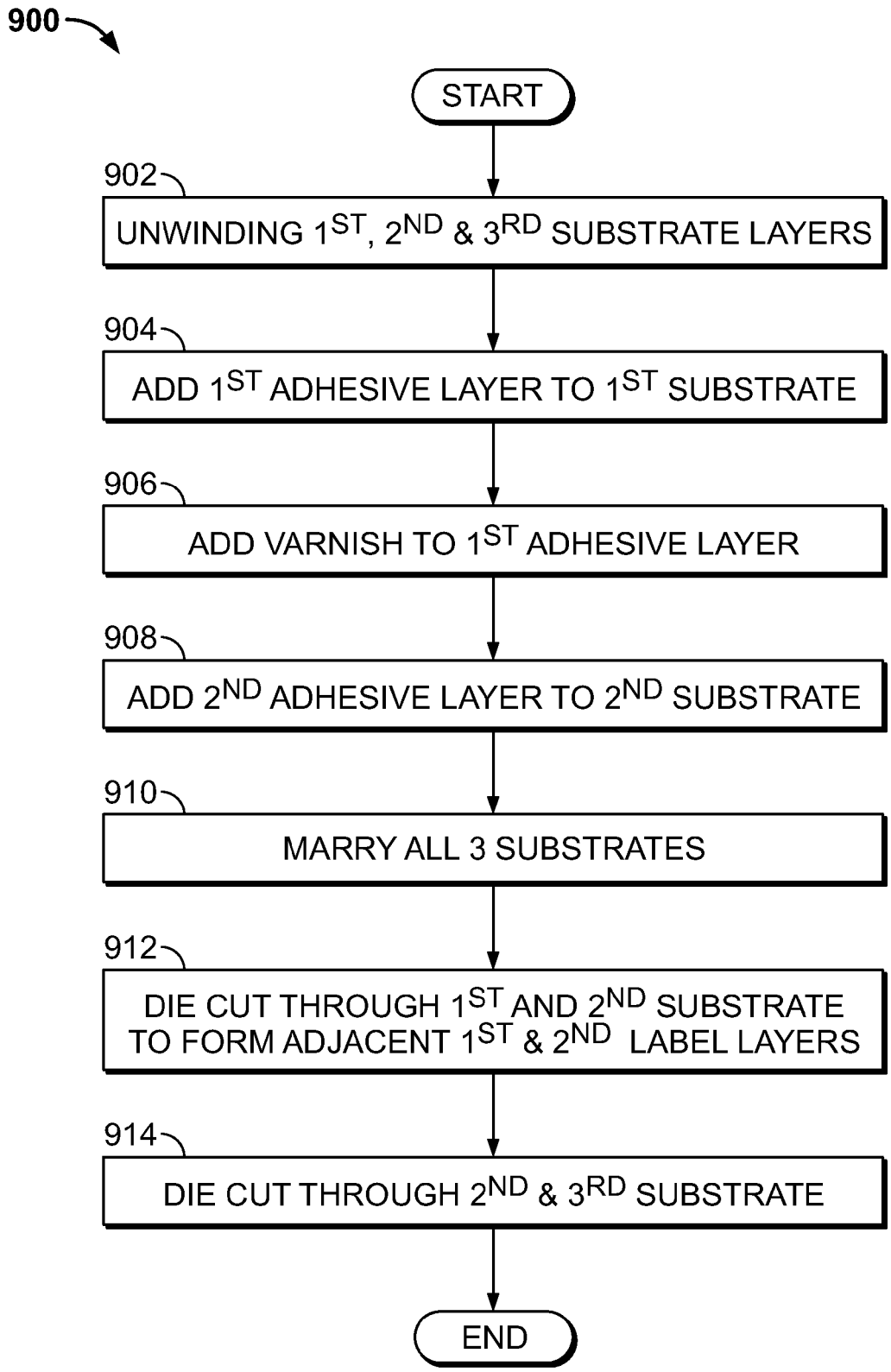
FIG. 12 is a flowchart depicting an example process to produce an example web of example shipment label intermediates.
Figure 13:
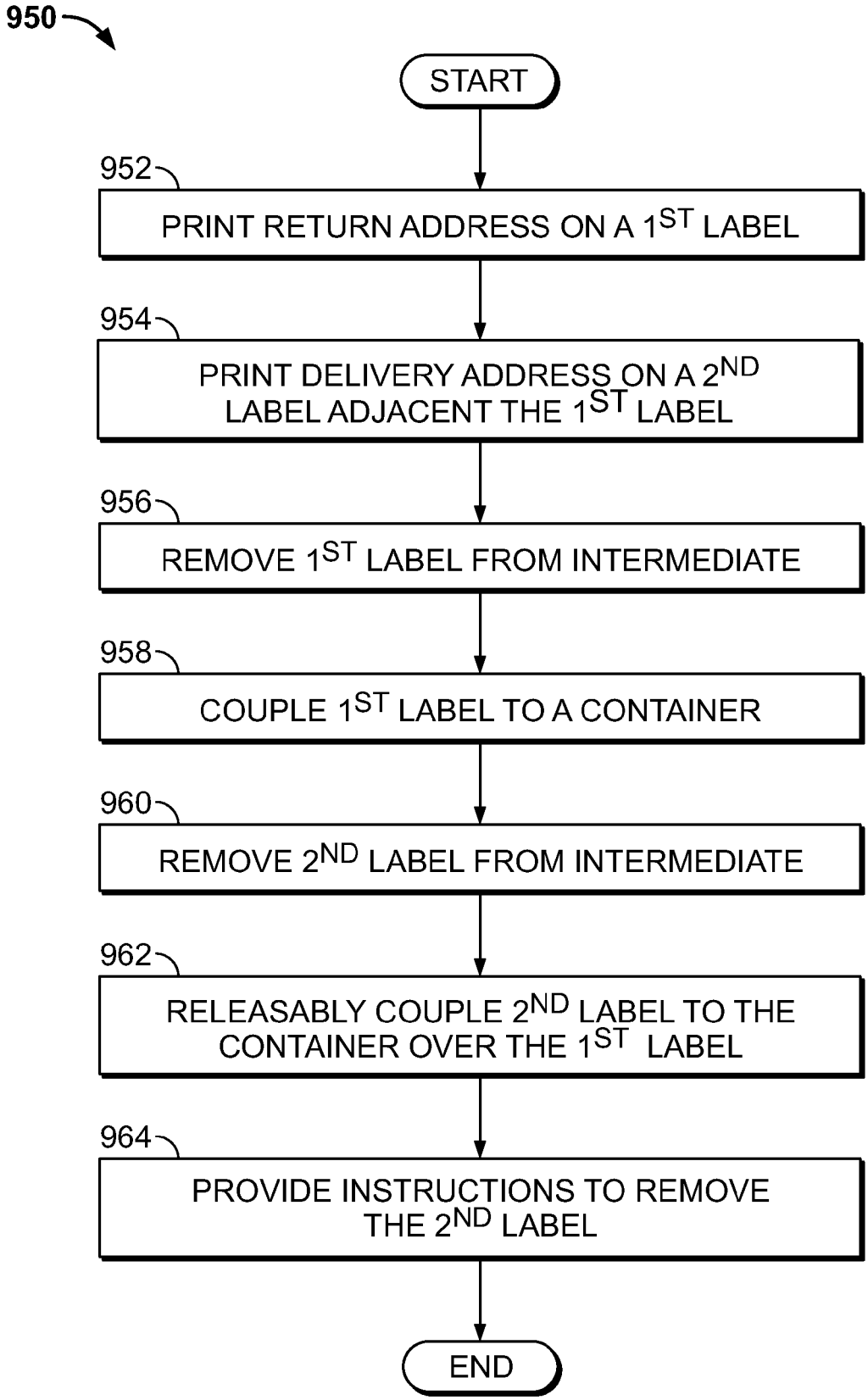
FIG. 13 is a flowchart depicting an example process to produce an example shipment label and container combination.

FIG. 12 is a flowchart of an example process 900 for creating a web of shipment label intermediates such as, for example, the web 200, 700 of the shipment label intermediates 202, 702 discussed above. In addition, FIG. 13 is a flowchart of an example process 950 for creating an example dual layer shipment layer and container combination such as, for example, the dual layer shipment label 300, 800 and container 302 discussed above. Although the example systems or processes are described with reference to the flowcharts illustrated in FIGS. 12 and 13, persons of ordinary skill in the art will readily appreciate that many other methods of creating a web of shipment label intermediates and/or of creating a dual layer shipment label and container combination may alternatively be used. For example, the order of execution of the blocks may be changed, and/or some of the blocks described may be changed, eliminated or combined.

In the example process of FIG. 12, a first substrate layer, a second substrate layer, and a third substrate layer (e.g., the top ply 104, the second ply 114 and the third or bottom ply 122, respectively) are unwound by, for example, first, second, and third unwinders 102, 112, 120, respectively (block 902). A first layer of adhesive is added to a first face of the first substrate layer (e.g., the adhesive layer 106*a*, 106*b* by, for example, the first adhesive station 106) (block 904) to line the first substrate layer with the first adhesive layer. The first adhesive layer may be a full coating of adhesive, a series of dots or strips or any other pattern. The first adhesive layer may be a releasable pressure sensitive adhesive, or any other suitable adhesive or cohesive. In addition, the first adhesive layer may include permanent adhesive in portions of the layer such as, for example, in the second portion 104*b* under the second label 206.

A varnish, silicone material or other deadening material (e.g., the first and/or second varnish portions 108*a*, 108*b*) is added to at least a portion of the first adhesive layer by, for example, the varnish station 108 (block 906) to coat or otherwise apply at least a portion of the first adhesive layer with a varnish in a first area, for example, a corner, to deaden the first adhesive layer in the first area.

The example process 900 of FIG. 12 also includes, adding a second adhesive layer (e.g., the second adhesive layer 116*a*, 116*b*) to a first side of a second substrate layer (e.g., the second ply 114) by, for example, the second adhesive station 116 and/or the first adhesive station 106, as described above (block 908). The second adhesive layer may be a releasable pressure sensitive adhesive, or any other suitable adhesive or cohesive. In addition, the second adhesive layer may include permanent adhesive in portions of the layer such as, for example, in the second portion 104*b* under the second label 206.

The three substrate layers are married by coupling the substrates together in, for example, the press 124 (block 910). Prior to marrying the substrates, they are oriented such that the first side of the first substrate layer is adjacent a second side of the second substrate layer via the first adhesive layer, and the first side of the second substrate layer is adjacent the third substrate layer via the second adhesive layer to form an intermediate construction (e.g., the shipment label intermediates 202, 702), in which a bottom side is at the third substrate layer and a top side is at the first substrate layer.

The example process 900 of FIG. 12 also includes cutting through the first and second substrate layers (e.g., the top ply 104 and the second ply 112 of the example intermediate construction 202, 702) from the top of the intermediate constructions 202, 702 to form a first label layer and a second label layer (e.g., top label 204, 704 and bottom layer 206, 706) adjacent to each other along a longitudinal axis of the intermediate construction (block 912). In the process, a waste matrix is formed comprising the portions of the top ply and the second ply outside of the first label layer and the second label layer (e.g., waste matrix 211, 711 as described above). In this example, a die cut is used. In other examples, the kiss cut, perforation, fold line or other line of weakness may be used in addition to or as an alternative to the die cut.

The example process 900 also includes cutting through the second and third substrate layers (e.g., the second play 12 and the bottom play 122 of the example intermediate construction 202, 702) from the bottom of the intermediate construction 202, 702 (block 914).

As mentioned above, FIG. 13 is a flowchart illustrating the example process 950 for creating an example dual layer shipment layer and container combination such as, for example, the dual layer shipment label 300, 800 and container 302 discussed above. In the example process 950 of FIG. 13, a first address such as, for example, a return address or the address to a service technician or other address (e.g., the return address 222, 722 described above) is printed on a first label (e.g., the bottom label 206, 706) (block 952). A second address such as, for example, an outgoing or delivery address or other address (e.g., the delivery address 220, 720 described above) is printed on a second label (e.g., the top label 204, 704) adjacent the first label (block 954).

The example process 950 also includes removing the first label (e.g., the bottom label 206, 706), from the intermediate construction (e.g., the intermediate construction 202, 702) (block 956) by pealing, for example, with the help of the die cuts 218, 716, the bottom label 206, 706 from the intermediate construction 202, 702 to separate the bottom label 206, 706 comprising, for example, the second portion 104*b* of the first ply 104, the second portion of the first adhesive layer 106*b*, the second portion 114*b* of the second ply 114 and the second portion of the second adhesive layer 116*b*, from the bottom ply 122. The first label (e.g., the bottom label 206, 706) is coupled to a container, e.g., the container 302 (block 958).

The example process 950 also includes removing the second label (e.g., the top label 204, 704) from the intermediate construction (e.g., the intermediate construction 202, 702) (block 960) by pealing, for example, with the help of the die cuts 218, 716, the top label 204, 704 from the intermediate construction 202, 702 to separate the top label 204, 704 comprising, for example, the first portion 104*a* of the first ply 104, the first portion of the first adhesive layer 106*a*, the first portion 114*a* of the second ply 114 and the first portion of the second adhesive layer 116*a*, from the bottom ply 122. The second label (e.g., the top label 204, 704) is coupled to the container (e.g., the container 302) over the first label (block 962). As described above, the first label and second label may be fully aligned, one may overly the other completely, they may overlap or otherwise be coupled to the container. Furthermore, in this example, the second label (e.g., the top label 204, 704) is releasably coupled, at least in part, over at least a portion of the first label (e.g., the bottom label 206, 706). In addition, when the second label is coupled to the top of the first label, the return address on the first label is not fully visible or not visible at all, but the delivery address on the second label is.

The example process 950 may also include providing instructions to the recipient of the container to remove at least a portion of the second label (e.g., the first portion 104*a* of the top ply 104 and related adhesive portion 106*a*) from the dual layer shipment label 300, 800 (block 964). The varnish 108*a* may facilitate the separation of the first portion 106*a* of the first adhesive layer from the second ply 114. Also, as noted above, the second ply 114 may be a clear protective layer, so the return address 222, 722, becomes fully visible once at least a portion of the top label 204, 704 is removed. The container is now ready for shipment to the return address.

The various features of the various examples described herein may added, omitted, combined or otherwise used in conjunction with any of the features of any other example.

Although certain example methods, apparatus, and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A web of shipment label intermediates, the web comprising:

a first substrate layer having a first side lined with a first adhesive layer;

a deadening material coating at least a portion of the first adhesive layer to deaden the portion of the first adhesive layer;

a second substrate layer having a first side lined with a second adhesive layer, wherein the first substrate and the second substrate layer are coupled so that the first side of the first substrate layer is adjacent a second side of the second substrate layer via the first adhesive layer;

a third substrate layer, wherein the second substrate layer and the third substrate layer are coupled so that the first side of the second substrate layer is adjacent the third substrate layer via the second adhesive layer;

a first line of weakness through the first, second and third substrate layers to form a plurality of intermediate constructions having a bottom side at the third substrate layer and a top side at the first substrate layer;

a second line of weakness formed from the bottom side through the second and third substrate layers;

a third line of weakness formed from the top side through the first and second substrate layers to form a first label and a second label adjacent to each other along a longitudinal axis of the intermediate construction and to form a waste matrix, at least a portion of the waste matrix to separate the first label and the second label; and a fourth line of weakness formed through the second and third substrate layers adjacent a corner of one of the first label or the second label, the fourth line of weakness to facilitate the removal of the one of the first label or the second label, the fourth line of weakness different from the second line of weakness.

2. A web of shipment label intermediates as defined in claim 1, wherein the first label is an outgoing address label and the second label is a return address label.

3. A web of shipment label intermediates as defined in claim 2, wherein the return address is an address of a business entity or nonprofit organization.

4. A web of shipment label intermediates as defined in claim 1, wherein the first adhesive layer includes a first portion of releasable adhesive under the first label and a second portion of permanent adhesive under the second label.

5. A web of shipment label intermediates as defined in claim 1, wherein the second adhesive layer includes a permanent adhesive.

6. A web of shipment label intermediates as defined in claim 1, wherein the first label is larger in area than the second label.

7. A web of shipment label intermediates as defined in claim 1, wherein the first label and the second label have different shapes.

8. A web of shipment label intermediates as defined in claim 1, wherein at least one of corners of at least one of the first label or the second label has a first radius and at least another one of the corners of at least one of the first label or the second label has a second radius different than the first radius.

9. A web of shipment label intermediates as defined in claim 1, wherein only a portion of the first label is removable from the second label.

10. A web of shipment label intermediates as defined in claim 1, wherein the first label includes first and second label portions or the second label includes first or second label portions.

11. A web of shipment label intermediates as defined in claim 1, wherein the first label is wholly separated from the second label.

12. A web of shipment label intermediates as defined in claim 1, wherein the first label is longitudinally separated from the second label.

13. A web of shipment label intermediates as defined in claim 1, wherein the waste matrix wholly surrounds one or more of the first label or the second label.

14. A web of shipment label intermediates as defined in claim 1, wherein the first label comprises three corners having a first radius and one corner having a second radius.

15. A web of shipment label intermediates as defined in claim 14, wherein the second radius is larger than the first radius.

16. A web of shipment label intermediates as defined in claim 15, wherein the fourth line of weakness is adjacent the second radius.

17. A web of shipment label intermediates as defined in claim 1, wherein one or more of the first label or the second label comprise a supplemental label to be used for book keeping or auditing.

* * * * *